US006102728A

United States Patent [19]

Shinchi

[11] Patent Number: 6,102,728

[45] **Date of Patent: *Aug. 15, 2000**

[54] CONNECTION STRUCTURE AND METHOD FOR ELECTRIC WIRE AND TERMINAL

[75] Inventor: Akira Shinchi, Shizuoka-ken, Japan

[73] Assignee: Yazaki Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/990,456

[22] Filed: Dec. 15, 1997

[30] Foreign Application Priority Data

Dec. 17, 1996 [JP] Japan ..... 8-337148

[51] Int. Cl.[7] ..... H01R 4/24

[52] U.S. Cl. ..... 439/397; 439/400; 439/701

[58] Field of Search ..... 439/395, 396, 439/397, 398, 399, 400–404, 527, 552–556, 701, 594–599

[56] References Cited

U.S. PATENT DOCUMENTS

| | | | |
|---|---|---|---|
| 4,252,397 | 2/1981 | Eigenbrode et al. | 439/397 |
| 4,929,193 | 5/1990 | Taylor | 439/567 |
| 5,694,681 | 12/1997 | Hatagishi et al. | 29/857 |
| 5,888,103 | 3/1999 | Norizuki et al. | 439/701 |
| 5,890,933 | 4/1999 | Okabe | 439/701 |

*Primary Examiner*—Lincoln Donovan
*Attorney, Agent, or Firm*—Finnegan, Henderson, Farabow, Garrett & Dunner, L.L.P.

[57] ABSTRACT

Terminals are inserted into groove portions of a first member and a covered wire is mounted on each of the terminals. Protrusions of a second member are engaged with the groove portions of the first member. The second member is pressed so that the covered wires are pressed against press-fit blades of the terminal so as to attain electric conductivity. By ultrasonic vibration in the pressing condition, the first member and second member are fused with each other. At the same time, by ultrasonic vibration, the cores of the covered wires are fused with each other and the core and the press-fit blades are fused with each other. By the fusing of the cores mutually and the core and press-fit blades, the contact area is increased thereby decreasing contact resistance.

7 Claims, 6 Drawing Sheets

CONNECTION STRUCTURE AND METHOD FOR ELECTRIC WIRE AND TERMINAL

BACKGROUND OF THE INVENTION

This invention relates to a connection structure and method for connecting an electric wire with a terminal by using ultrasonic vibration.

Japanese Unexamined Patent Application No.Hei7-70345 has disclosed an art for making a terminal into conductive contact with the cores of a covered wire by ultrasonic vibration, without peeling an insulating cover of the covered wire.

FIG. 5 shows a connector produced in this prior art method, which comprises a first member 1 and second member 2 which are formed of resin and assembled so as to oppose each other.

A groove portion 3 is formed on a top face of a first member 1 in the length direction thereof, and small concave portions 4 are formed at appropriate intervals in the length direction of the groove portion 3. Into the groove portion 3 of the first member 1 is inserted the terminal 5 along the length thereof and then a covered wire is placed on the terminal 5. The covered wire 6 is placed in a state in which a plurality of cores are covered with an insulating cover.

On a bottom of the second member 2 is formed a protrusion portion 7 which engages the groove portion 3 of the first member 1. Further, small convex portions 8 which engage the concave portions of the groove portion 3 are formed.

Upon assembly of the connector, with the terminal 5 and covered wire 6 inserted into the groove portion 3, the protrusion 7 of the second member 2 is engaged with the groove portion 3 of the first member 1, and the terminal 5 and covered wire 6 are pressed by means of the second member 2 and first member 1. At this time, where the convex portion 8 engages the concave portion 4, the terminal 5 and covered wire 6 are partially bent so as to act as a stopper against being loose.

Then, the first member 1 and second member 2 are pinched, and ultrasonic vibration is carried out by means of a horn (not shown). Due to heat generated by vertical vibration by the ultrasonic vibration, the insulating cover of the covered wire 6 is fused and removed out, so that the cores of the covered wire 6 and terminal 5 are made into contact with each other so that they are conductively contacted with each other. At the same time as this conductive contacting, the first member 1 and second member 2 are fused with each other, so that a connector containing the terminal 5 and wire is produced.

FIG. 6 shows a prior art structure for producing a multipolar connector. In a first member 1 are formed a plurality of the groove portions 3 and a second member 2 contains a plurality of protrusions 7 opposing the groove portions 3.

Upon assembly of the connector, the terminal is contained in each of the groove portions 3, and a covered wire is placed on the terminal. After that, these components are pressed by the first member 1 and second member 2, and then ultrasonic vibration is carried out in the same manner as described above.

In the structure shown in FIG. 6, small concave portions are formed in each of the groove portions 3 of the first member 1 like in the structure shown in FIG. 5 and small convex portions are formed on each of the protrusions 7 of the second member 2.

FIG. 7 shows a state in which the terminal 5 and covered wire 6 are pinched by the first member 1 and second member 2 having the above described structure. The terminal 5 and covered wire 6 are overlapped with each other by the pressing of the protrusion of the second member 2. A portion corresponding to the convex portion 8 and concave portion 4 is bent. Reference numerals 5*a*, 6*a* indicate these bent portions. Because the bent portions 5*a*, 6*a* are formed in the terminal 5 and covered wire 6 as described above, the connector is prevented from slipping out.

However, even if the terminal 5 and covered wire 6 are bent by the concave portions 4 and convex portions 8 so as to prevent them from slipping out, when a pulling tension is applied to the terminal 5 and covered wire 6, they are separated from each other, so that a contact area between the covered wire and terminal may be decreased. If the contact area between the cores and terminal is decreased, contact resistance of the entire connection portion between the terminal and cores is increased, so that generation of heat, deterioration of the material quality due to that generation of heat or other problem may occur.

Further, because the terminal 5 is bent by the concave portion 4 and convex portion 8, a dimension thereof must be determined taking this bent portion into account. Therefore, the dimension control of the terminal is troublesome.

SUMMARY OF THE INVENTION

Accordingly, it is an object of the present invention to provide a connection structure and connection method for a wire and terminal, wherein contact resistance of an entire connection portion between a terminal and covered wire is minimized so as to prevent generation of heat and wherein the dimension control of the terminal is facilitated.

According to the present invention, there is provided a conductive connection structure for a covered wire and terminal, comprising: a first member formed of non-conductive material; a groove portion formed in the first member; a terminal to be included in the groove portion, having a press-fit blade; a covered wire including a plurality of bundle of cores and a insulating cover for covering an outside face thereof; a second member formed of non-conductive material; and a protrusions formed on the second member for closing the groove portion, wherein the protrusion presses the covered wire mounted on the terminal against the terminal when the groove portion is closed so that the covered wire is press-fit to the press-fit blade, the second member is excited by ultrasonic vibration with the protrusion closing the groove portion, so that the cores are fused with each other by the ultrasonic vibration.

According to this structure, when the protrusion of the second member closes the groove portion of the first member, the protrusion press-fit the covered wire to the press-fit blade. By this press-fitting, the press-fit blade bite the insulating cover of the covered wire so as to conductively contact the cores inside the insulating cover. Thus, the covered wire can be rigidly held. In this state, even if a pulling tension is applied to the terminal and covered wire, because the press-fit blade engage the insulating cover in the same direction as that pulling tension, the terminal and covered wire are not separated from each other. Therefore, an increase of the contact resistance due to decrease of the contact area which may be caused by the separation is not induced.

In the ultrasonic vibration, the cores of the covered wire are fused with each other. Despite that the adjacent cores are in linear contact with each other because they are originally circular in its shape, the adjacent cores are fused with each other so that they are in contact with each other in that fusion state. Thus contact resistance between the cores is decreased tremendously.

By the above described operation, entire contact resistance of the terminal and covered wire is decreased thereby reducing generation of heat.

Further, in this structure, the terminal does not have to be bent, and therefore a dimension control of the terminal is facilitated.

Further, it is permissible to provide the protrusion with recess portion in which the press-fit blade is to be inserted. This prevents an interference between the protrusion and press-fit blade, so that the covered wire is securely made into contact with the press-fit blade by the protrusion.

Further, the first and second members can be formed of resin material. Still further, the first and second members can be fused with each other by ultrasonic vibration.

By the fusing of the press-fit blade and cores, they are mutually fused with each other so as to increase contact area. Thus, the entire contact resistance between the terminal and covered wire is further reduced.

Further, it is permissible to so construct that the first member is a connector housing containing a plurality of the groove portions which are arranged in a single column; the terminal is a crimp terminal including a bottom wall portion, side wall portions rising from both sides of the bottom wall portion, and the press-fit blades bent inwardly from each of the side wall portions; the second member is a cover member for covering a part of the connector housing in which the groove portions are formed; the cover member contains a plurality of the protrusions arranged in a single column; and the protrusions are inserted between the side wall portions of the terminal.

Further, ultrasonic vibration can be applied to such a connector so constructed to be connected to the covered wire by using the crimp terminal.

DESCRIPTION OF THE PREFERRED EMBODIMENTS

Hereinafter, an embodiment of the present invention will be described with reference to the accompanying drawings.

Figure 1:
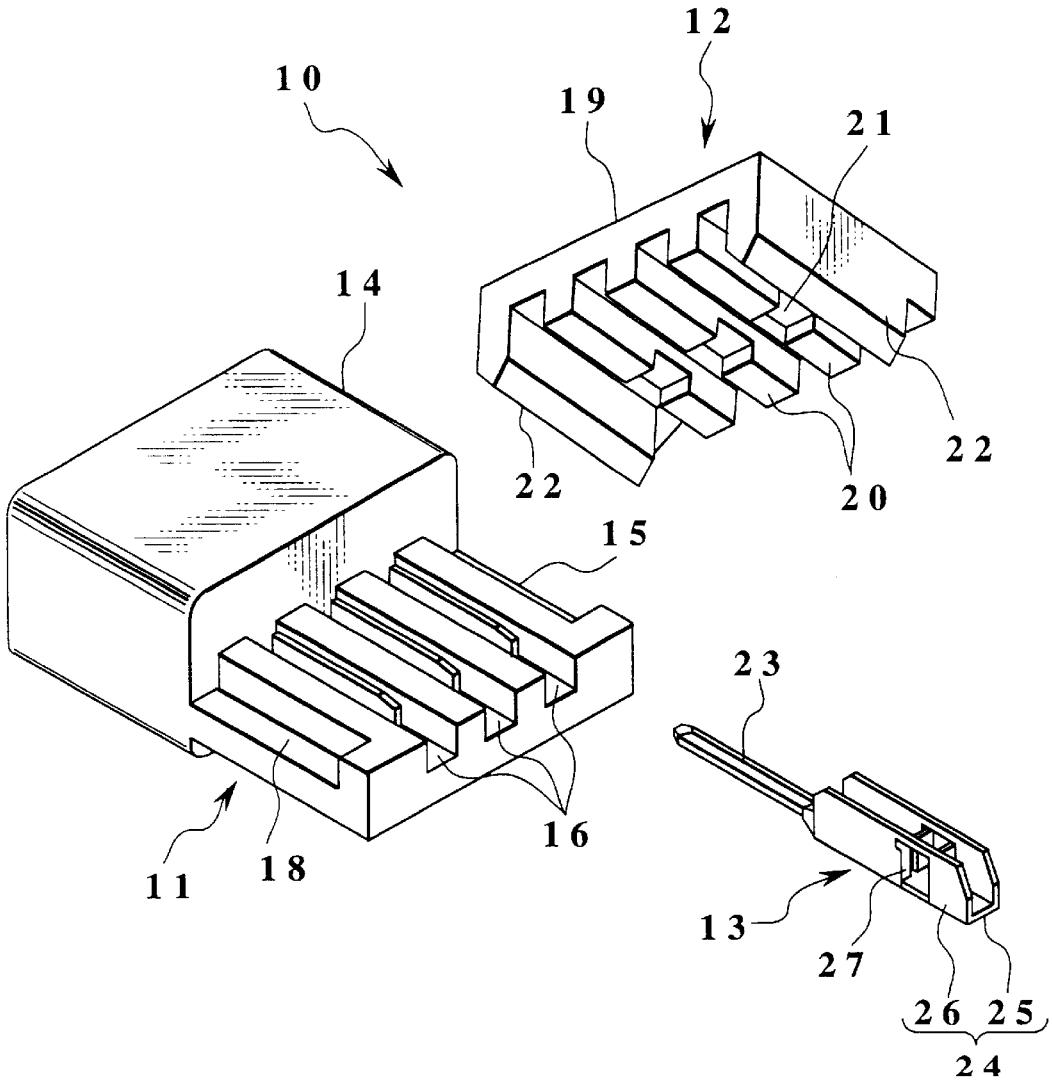
FIG. 1 is a disassembly perspective view of an embodiment of the present invention.
Figure 2:
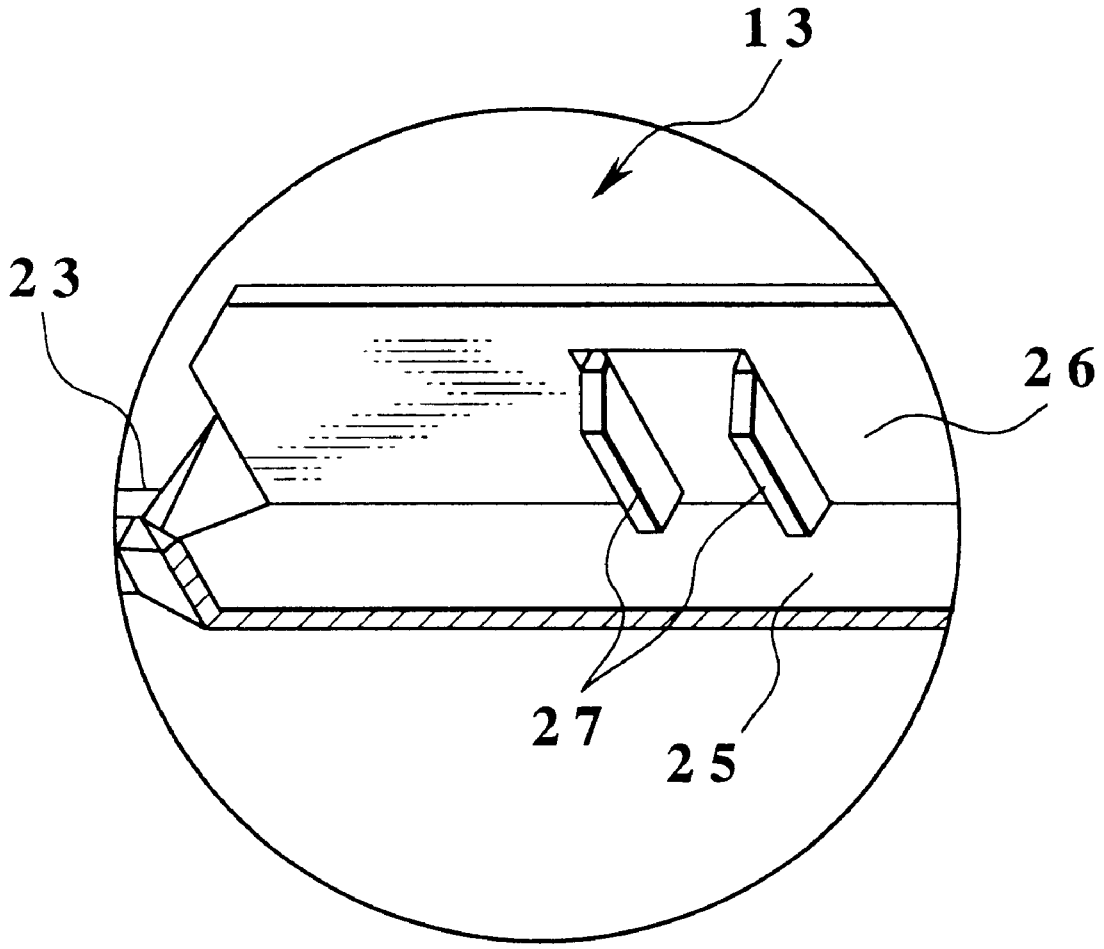
FIG. 2 is an enlarged perspective view of a press-fit blade portion of a terminal.
Figure 3:
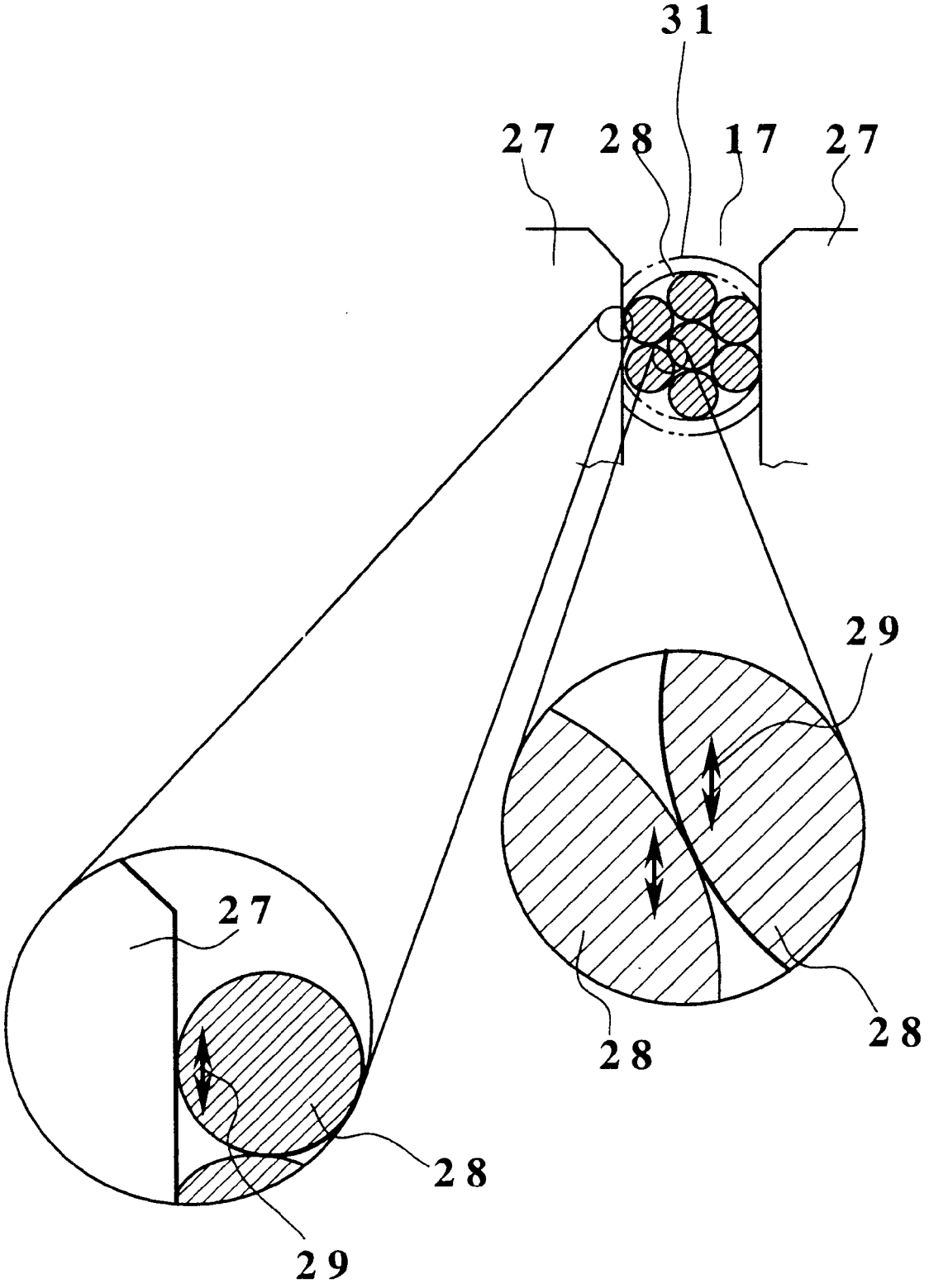
FIG. 3 is a sectional view showing an operation of ultrasonic vibration to press-fit blades and cores.
Figure 4:
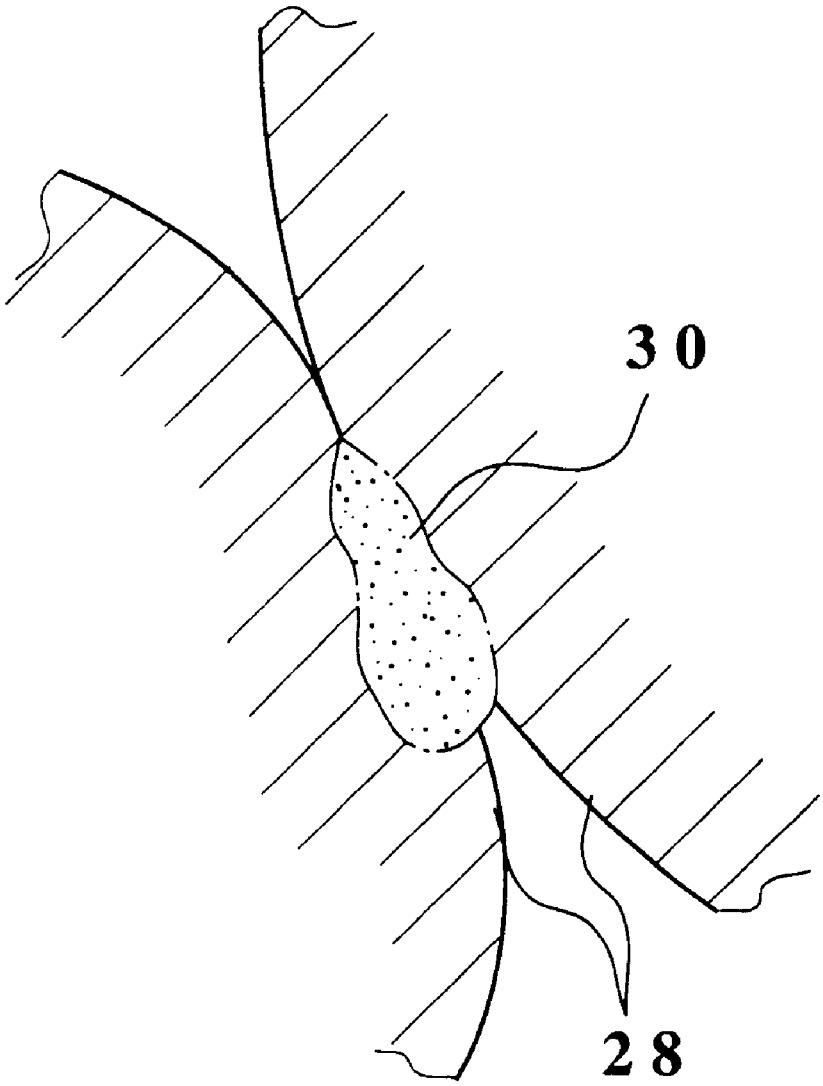
FIG. 4 is an illustration of a microscope photograph showing an operation of ultrasonic vibration to the cores.
Figure 5A:
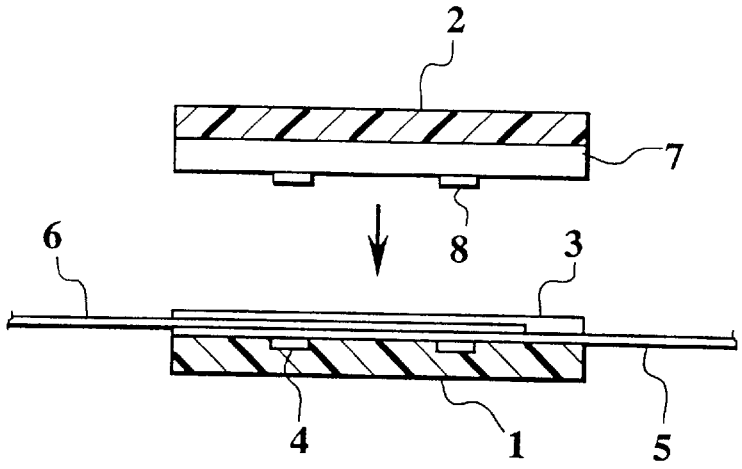
FIG.5A PRIOR ART
FIG. 5A is a sectional view of a connection structure of the prior art.
Figure 5B:
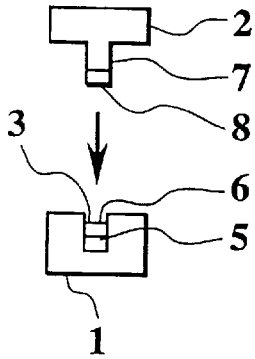
FIG.5B PRIOR ART
FIG. 5B is a front view of FIG. 5A.
Figure 6:
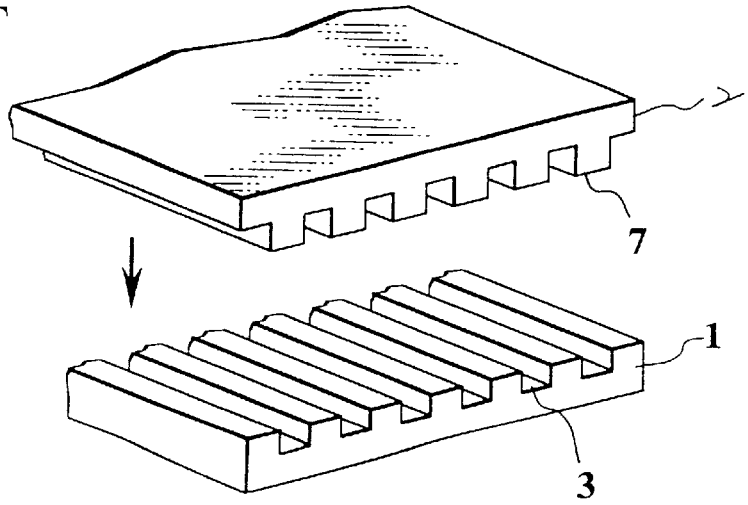
FIG.6 PRIOR ART
FIG. 6 is a disassembly perspective view of another connection structure of the prior art.
Figure 7:
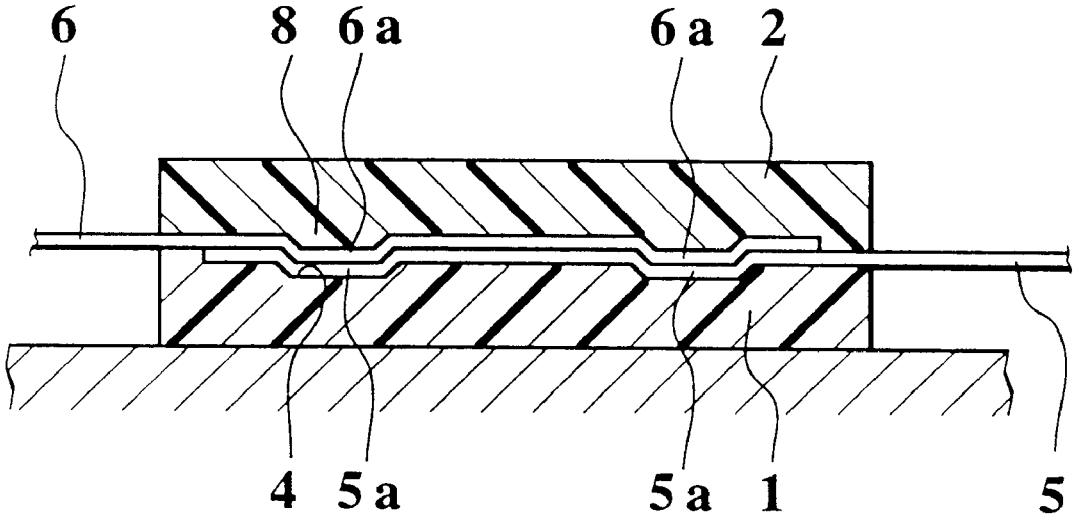
FIG.7 PRIOR ART
FIG. 7 is an enlarged sectional view of a connection structure of the prior art.

FIG. 1 is a disassembly perspective view of an entire structure of an embodiment of the present invention. FIG. 2 is an enlarged partial perspective view of a terminal and FIGS. 3, 4 are sectional views showing an action by ultrasonic vibration.

In this embodiment, the present invention has been applied to a connector 10.

As shown in FIG. 1, the connector 10 includes a connector housing 11 which is a first member, a cover member 12 which is a second member and a crimp terminal 13 formed of conductive metal. The connector housing 11 and cover member 12 are formed of resin material.

The connector housing 11 comprises a housing body 14 which is to be engaged with a mating connector (not shown) for connection and wire holding portions 15 which are provided integrally on one side thereof so that they are arranged in a single column.

The wire holding portions 15 include groove portions 16 having a rectangular cross section the top of which is open and which are formed in parallel. In each of the groove portions 16 is incorporated a terminal 13 so that connection between the covered wire 17 (see FIG. 3) and the terminal 13 is performed. On both ends of the wire holding portion 15 are provided indented portions 18 which are to be melt-fixed to the cover members 12, such that they are arranged in parallel to the groove portions 16.

The cover member 12 contains a flat shaped cover body 19 and a plurality of protrusions 20 formed on one side of the cover body 19. Each of the protrusions 20 is formed with the same cross section as the groove portion 16 of the connector housing 11. Each of the protrusions 20 is engaged with the groove portion 16 so as to close the groove portion 16. In this case, the protrusion 20, as described later, closes the groove portion 16 in the state in which the terminal 13 is contained in the groove portion 16. The width of the protrusion 19 is determined so as to close an inside of the groove portion 16 except side wall portions 26 of the terminal 13.

In each of the protrusions 20 is formed a recess portion 21 which is indented. A press-fit blade 27 formed in the terminal 13 is inserted into the recess portion 21, thereby preventing an interference between the protrusion 20 and the press-fit blade 27.

On both sides of the cover body 19 are formed contacting portions 22 which are parallel to the protrusions 20. The contacting portions 22 come into contact with the dent portions 18 of the connector housing 11 and are fused therewith. As a result, the connector housing 11 is integrated with the cover member 12. Because the contacting portions 22 are formed in a shape which narrows gradually up to a tip thereof, the fusing is facilitated.

The terminal 13 which is a crimp terminal comprises a pin shaped contacting portion 23 and a wire connecting portion 24 which is provided so as to be continuous with the contacting portion 23. The pin shaped contacting portion 23 goes through the housing body 14 of the connector housing 11, so that it is engaged with the contacting portion of the mating connector terminal which engages the housing body 14 so as to perform electrical connection therebetween.

As shown in FIGS. 1, 2, the wire connection portion 24 comprises a bottom wall portion 25 extending in the direction of the length thereof and side wall portion 26 rising up from both sides of the bottom wall portion 25, so as to form a rectangular shape the top of which is open. On the bottom wall portion 25 of the wire connection portion 24 is mounted a covered wire 17, and the press-fit blades 27 are formed on the side wall portion 26.

The press-fit blades 27 are formed by incising opposing portions of the side wall portions 26 and bending those incised portions inwardly. Consequently, the press-fit blades 27 are protruded inside of the wire connection portion 24. As shown in FIG. 3, the press-fit portions 27 bite insulating cover 31 of the covered wire 17 pressed into the wire connection portion 24 so as conductively contact the cores 28 inside the insulating cover 31.

This terminal may be entirely tinned or only the press-fit portions may be tinned. This improves electric conductivity and provides corrosion resistance.

According to this embodiment, the connector housing 11 and cover member 12 are fused by ultrasonic vibration so as to be integrated with each other. Upon this ultrasonic vibration, the cores 28 in the covered wire 17 are fused with each other and the cores 28 are fused with the press-fit blades 27.

Next, assembly of this embodiment will be described.

As shown in FIG. 1, the terminal 13 is inserted into each of the grooves 16 of the connector housing 11 so as to make the contacting portion 23 of the terminal 13 go through the housing body 14. Then, the covered wire 17 is inserted into the wire connection portion 24 of the terminal 13. Then, the cover member 12 is mounted on the wire holding portion 15 of the connector housing 11. At this time, with each of the protrusions 20 matching each of the grooves 16, the cover member 12 is pressed.

By this pressing, the covered wire 17 is pressed against the press-fit blades 27 through the protrusion 20, so that the press-fit blades 27 bite the insulating cover 31 of the covered wire 17 and contact the cores 28 inside (see FIG. 3). Consequently, the terminal 13 conductively contacts the covered wire 17. Because this press-fit blades 27 bite, the covered wire 17 is held securely by the terminal 13. Thus, even if a tension force is applied to the covered wire 17 and terminal 13, they are not separated from each other. Because the press-fit blades 27 are inserted into the recess portion 21 formed in the protrusion 20, they are not obstacle to this pressing work.

With this pressing condition, a horn (not shown) is brought into contact with the wire holding portion 15 and cover body 19 and ultrasonic vibration is performed. By this ultrasonic vibration, the indented portions of the connector housing 11 are fused with the contacting portions 22 of the cover member 12 so as to be integrated with each other. Consequently, the connector 10 is formed.

Upon this ultrasonic vibration, oscillated ultrasonic vertical vibration acts between the cores 28, and between the cores 28 and press-fit blades 27.

FIG. 3 shows this action. Vertical vibration is applied to the cores 28 adjacent to each other, so that the cores 28 are fused with each other. At the same time, the press-fit blades 27 and the cores 28 are subject to the vertical vibration 29, so that they are fused with each other.

FIG. 4 illustrates a microscope photograph observing the fusion condition between the cores. Prior to application of ultrasonic vibration, the core having a substantially circular shape is in linear contact with the adjacent core 28. Upon the ultrasonic vibration, the contacting portions are fused mutually so as to form a fused portion 30. This fused portion 30 changes the adjacent cores 28 from ordinary mechanical contacting condition to an integral connection condition, and increases the contacting area around the fused portion 30. Consequently, the contacting area between the cores is increased so as to decrease contact resistance between the cores tremendously.

The same thing can be said between the press-fit blades 27 and cores 28. As shown in enlarged views of FIG. 3, the vertical vibration 29 is applied, so that the press-fit blades 27 and cores 28 are fused with each other in the same way as described above. Consequently, the contact area therebetween is increased. Thus, the contact resistance therebetween is reduced.

In this embodiment, by the pressing of the press-fit blades 27, the covered wire 17 is rigidly held. Thus, even if a tension force is applied to the terminal 13 and covered wire 17, they are not separated from each other, and increase of contact resistance because of decrease of the contact area which may occur by separation is not caused.

By the ultrasonic vibration, the cores 28 of the covered wires 17 are mutually fused and the press-fit blades 27 and the core 28 are fused with each other, so that the contacting area is increased. Therefore, the contact resistance of the entire connection portion between the terminal 13 and covered wire 17 is decreased so as to decrease generation of heat thereby preventing deterioration due to that heat.

Further, because the terminal 13 does not have to be bent upon connection, the dimensional control for the terminal 13 is facilitated.

Meantime, according to the present invention, if electric conduction is sufficiently secured by press-fitting between the press-fit blades 27 and the cores 28, they do not have to be fused with each other by ultrasonic vibration.

What is claimed is:

1. A connection structure for a covered wire and terminal, comprising:

a first member formed of non-conductive material;

a groove portion formed in said first member;

a terminal to be included in said groove portion, having a press-fit blade, said terminal having side wall portions rising from both sides of said bottom wall portion, and said press-fit blade having a plurality of blades integral with each of said side wall portions and bent inwardly from each of said side wall portions;

a covered wire including a plurality of bundle of cores and an insulating cover for covering an outside face thereof;

a second member formed of non-conductive material; and protrusions formed on said second member for closing said groove portion, wherein said protrusion presses the covered wire mounted on said terminal against said terminal when said groove portion is closed so that said covered wire is press-fit to said press-fit blade, said second member is excited by ultrasonic vibration with said protrusion closing said groove portion, so that said cores are fused with each other by said ultrasonic vibration.

2. A connection structure for the covered wire and terminal according to claim 1 wherein said protrusion has a recess portion.

3. A connection structure for the covered wire and terminal according to claim 1 wherein said first and second members are formed of resin material.

4. A connection structure for the covered wire and terminal according to claim 1 wherein said first and second members are fused with each other by said ultrasonic vibration.

5. A connection structure for the covered wire and terminal according to claim 1 wherein said press-fit blade and said cores are fused with each other by said ultrasonic vibration.

6. A connection structure for the covered wire and terminal according to claim 1 wherein said first member is a connector housing containing a plurality of said groove portions which are arranged in a single column;

said terminal is a crimp terminal including a bottom wall portion, side wall portions rising from both sides of said bottom wall portion, and said press-fit blade having a plurality of blades integral with each of said side wall portions and bent inwardly from each of said side wall portions;

said second member is a cover member for covering a part of said connector housing in which said groove portions are formed;

said cover member contains a plurality of said protrusions arranged in a single column; and said protrusions are inserted between said side wall portions of said terminal.

7. A connection method for a covered wire and terminal, by means of a connection structure comprising:

a first member formed of non-conductive material, a groove portion formed in said first member, a terminal to be included in said groove portion, having a press-fit blade, said terminal having side wall portions rising from both sides of said bottom wall portion, and said press-fit blade having a plurality of blades integral with each of said side wall portions and bent inwardly from each of said side wall portions, a covered wire including a plurality of bundle cores and an insulating cover for covering an outside face thereof, a second member formed of non-conductive material, and a protrusion formed on said second member for closing said groove portion;

said connection method comprising:

a first step of mounting the covered wire on said terminal;

a second step of closing said groove portion by said protrusion, pressing said covered wire to said press-fit blade; and a third step of exciting said second member by ultrasonic vibration with said groove portion closed by said protrusion and fusing the plurality of said cores with each other.

* * * * *